United States Patent [19]

Kanbe et al.

[11] 4,292,387

[45] Sep. 29, 1981

[54] MAGNETIC DEVELOPING METHOD UNDER A.C. ELECTRICAL BIAS AND APPARATUS THEREFOR

[75] Inventors: Junichiro Kanbe, Tokyo; Tsutomu Toyono, Higashi; Nagao Hosono, Chofu; Tohru Takahashi, Tokyo, all of Japan

[73] Assignee: Canon Kabushiki Kaisha, Tokyo, Japan

[21] Appl. No.: 58,435

[22] Filed: Jul. 18, 1979

[30] Foreign Application Priority Data

| | | | |
|---|---|---|---|
| Jul. 28, 1978 | [JP] | Japan | 53-92108 |
| Apr. 28, 1979 | [JP] | Japan | 54-52640 |
| Jun. 11, 1979 | [JP] | Japan | 54-68564 |

[51] Int. Cl.[3] ..... G03G 13/09; G03G 15/09

[52] U.S. Cl. ..... 430/102; 430/103; 430/903; 118/653; 118/657; 355/3 DD

[58] Field of Search ..... 430/102, 103, 903; 118/653, 657; 355/3 DD

[56] References Cited

U.S. PATENT DOCUMENTS

| | | | |
|---|---|---|---|
| 3,346,475 | 10/1967 | Matkan et al. . | |
| 3,866,574 | 2/1975 | Hardenrook et al. . | |
| 3,890,929 | 6/1975 | Walkup | 355/3 DD X |
| 3,893,418 | 7/1975 | Liebman et al. | 355/3 DD X |
| 3,918,966 | 11/1975 | Metcalfe et al. | 430/103 |
| 4,014,291 | 3/1977 | Davis | 118/657 |
| 4,102,305 | 7/1978 | Schwarz | 118/651 |

*Primary Examiner*—Roland E. Martin, Jr.

*Attorney, Agent, or Firm*—Fitzpatrick, Cella, Harper & Scinto

[57] ABSTRACT

This specification discloses a method of toner transfer development in which one-component magnetic developer is conveyed to a developing position by the action of a magnetic field and a low frequency alternating electrical bias is applied to the space between a latent image bearing member and a developer carrying member at that position to thereby develop a latent image. This development provides visible images excellent in sharpness and tone reproduction.

32 Claims, 36 Drawing Figures

MAGNETIC DEVELOPING METHOD UNDER A.C. ELECTRICAL BIAS AND APPARATUS THEREFOR

BACKGROUND OF THE INVENTION

1. Field of the Invention

This invention relates to a developing method for developing a latent image by the use of a developer and an apparatus therefor, and more particularly to a developing method using a one-component developer, especially a developing method which enables production of fogless visible images excellent in sharpness and tone reproduction, and an apparatus therefor.

2. Description of the Prior Art

Various types of developing methods using a one-component developer are heretofore known such as the powder cloud method which uses toner particles in cloud condition, the contact developing method in which a uniform toner layer formed on a toner supporting member comprising a web or a sheet is brought into contact with an electrostatic image bearing surface to effect development, and the magnedry method which uses a conductive magnetic toner formed into a magnetic brush which is brought into contact with the electrostatic image bearing surface to effect development.

Among the above-described various developing methods using one-component developer, the powder cloud method, the contact developing method and the magnedry method are such that the toner contacts both the image area (the area to which the toner should adhere) and the non-image area (the background area to which the toner should not adhere) and therefore, the toner more or less adheres to the non-image area as well, thus unavoidably creating the so-called fog.

To avoid such fog, there has been proposed the transfer development with a space between a toner donor and an image bearing member in which a toner layer and an electrostatic image bearing surface are disposed in opposed relationship with a clearance therebetween in a developing process so that the toner is caused to fly to the image area by the electrostatic field thereof and the toner does not contact the non-image area. Such development is disclosed, for example, in U.S. Pat. Nos. 2,803,177; 2,758,525; 2,838,997; 2,839,400; 2,862,816; 2,996,400; 3,232,190 and 3,703,157. This development is a highly effective method in preventing the fog. Nevertheless, the visible image obtained by this method generally suffers from the following disadvantages because it utilizes the flight of the toner resulting from the electric field of the electrostatic image during the development.

A first disadvantage is the problem that the sharpness of the image is reduced at the edges of the images. The state of the electric field of the electrostatic image at the edge thereof is such that if an electrically conductive member is used as the developer supporting member, the electric lines of force which emanate from the image area reach the toner supporting member so that the toner particles fly along these electric lines of force and adhere to the surface of the photosensitive medium, thus effecting development in the vicinity of the center of the image area. At the edges of the image area, however, the electric lines of force do not reach the toner supporting member due to the charge induced at the non-image area and therefore, the adherence of the flying toner particles is very unreliable and some of such toner particles barely adhere while some of the toner particles do not adhere. Thus, the resultant image is an unclear one lacking sharpness at the edges of the image area, and line images, when developed, give an impression of having become thinner than the original lines.

To avoid this in the above-described toner transfer development, the clearance between the electrostatic image bearing surface and the developer supporting member surface must be sufficiently small (e.g. smaller than 100 $\mu$) and actually, asccidents such as pressure contact of the developer and mixed foreign substances are liable to occur between the two surfaces. Also, maintaining such a fine clearance often involves difficulties in designing of the apparatus.

A second problem is that images obtained by the above-described toner transfer development usually lack toner reproducibility. In the toner transfer development, the toner does not fly until the toner overcomes the binding power to the toner supporting member by the electric field of the electrostatic image. This power which binds the toner to the toner supporting member is the resultant force of the Van der Waals force between the toner and the toner supporting member, the force of adherence among the toner particles, and the reflection force between the toner and the toner supporting member resulting from the toner being charged. Therefore, flight of the toner takes place only when the potential of the electrostatic image has become greater than a predetermined value (hereinafter referred to as the transition threshold value of the toner) and the electric field resulting therefrom has exceeded the aforementioned binding force of the toner, whereby adherence of the toner to the electrostatic image bearing surface takes place. But the binding power of the toner to the supporting member differs in value from particle to particle or by the particle diameter of the toner even if the toner has been manufactured or prepared in accordance with a predetermined prescription, and therefore, it is considered to be distributed narrowly around a substantially constant value and correspondingly, the threshold value of the electrostatic image surface potential at which the flight of toner takes place also seems to be distributed narrowly around a certain constant value. Such presence of the threshold value during the flight of the toner from the supporting member causes adherence of the toner to that part of the image area which has a surface potential exceeding such threshold value, but causes little or no toner to adhere to that part of the image area which has a surface potential lower than the threshold value, with a result that there are only provided images which lack the tone gradation having steep $\gamma$ (the gradient of the characteristic curve of the image density with respect to the electrostatic image potential).

In view of such problems, a developing device in which a pulse bias of very high frequency is introduced across an air gap to ensure movement of charged toner particles flying through the air gap, whereby the charged toner particles are made more readily available to the charged image is disclosed in U.S. Pat. Nos. 3,866,574; 3,890,929 and 3,893,418.

Such high frequency pulse bias developing device may be said to be a developing system suitable for line copying in that a pulse bias of several KHz or higher is applied in the clearance between the toner donor member and the image retaining member to improve the vibratory characteristic of the toner and prevent the toner from reaching the non-image area in any pulse bias phase but cause the toner to transit only to the image area, thereby preventing fogging of the non-image area. However, the aforementioned U.S. Pat. No. 3,893,418 states that a very high frequency (18 KHz–22 KHz) is used for the applied pulse voltage in order to make the device suitable for the reproduction of tone gradation of the image.

U.S. Pat. No. 3,346,475 discloses a method which comprises immersing two electrodes in insulating liquid contained in a dielectrophoretic cell and applying thereto an AC voltage of very low frequency (lower than about 6 Hz) to thereby effect the development of a pattern corresponding to the conductivity variance.

Further, U.S. Pat. No. 4,014,291 dicloses a method in which dry, one component magnetic toner on the non-magnetic, non-conductive transfer cylinder which encloses a rotating cylindrical magnet is transferred to the deposit zone to develop an electrostatic latent image on coated paper, but this patent does not suggest that a bias is applied for the above-described purpose.

SUMMARY OF THE INVENTION

It is an object of the present invention to provide a developing method in which a latent image is developed by subjecting a magnetic developer to the action of an electric field and applying a low frequency alternating voltage to the developing clearance with a view to improve the tone reproduction in transfer development, and an apparatus therefor.

It is another object of the present invention to provide a developing method based on the principle of development in which a low frequency alternate electric field having a phase of a particular polarity which causes the developer to one-sidedly reach both the image area and the non-image area of a latent image bearing member from a developer carrier and a phase of the opposite polarity to the particular polarity which applies a bias in a direction to cause the developer having reached at least the non-image area to return to the developer carrier side is applied in the developing clearance to thereby ensure transition of the developer to the non-image area and back transition of the developer to the developer carrier to be alternately repeated even in the clearance between the developer carrier and the non-image area in the developing station and enable a development very excellent in tone reproduction to be accomplished by such reciprocal movement of the developer, and an apparatus therefor.

It is still another object of the present invention to provide an electrostatic image developing method in which a magnetic developer is conveyed to the developing station while being restrained on a developer carrier by the action of a magnetic field and in the developing station, the developer carrier is disposed in opposed relationship with an electrostatic image bearing member with a clearance maintained therebetween, the clearance being greater than the thickness of the magnetic developer layer and development is effected by applying an alternate electric field of low frequency (preferably lower than 1.5 KHz) so that the bias field in the developing clearance alternates the magnetic developer particles both in the image area and the non-image area, and an apparatus therefor.

It is yet still another object of the present invention to provide a developing method in which the clearance between the electrostatic image bearing member and the developer carrier during the developing process is varied with time so as to vary the intensity of the alternate electric field affecting the developer, and an apparatus therefor.

It is a further object of the present invention to provide a developing method in which the electrostatic latent image bearing member and the developer carrier carrying thereon a developer layer are disposed in opposed relationship in the developing station with a clearance maintained therebetween and development is effected by applying an alternate voltage of low frequency below 1.5 KHz between the back electrode of the latent image bearing member and the developer carrier, the frequency and voltage value of the applied alternate voltage being selected to effect optimal visualization of the image in accordance with the kind of the image (for example, line image, half-tone image of a photograph or the like, colored image, etc.), and an apparatus therefor.

Other objects and features of the present invention will become apparent from the following description of some embodiments of the invention taken in conjunction with some accompanying drawings.

DESCRIPTION OF THE PREFERRED EMBODIMENTS

The principle of the present invention will be described by reference to FIG. 1. In the lower portion of FIG. 1, there is shown a voltage waveform applied to a toner carrier. It is shown as a rectangular wave, whereas it is not restricted thereto. A bias voltage of the negative polarity having a magnitude of Vmin is applied at a time interval t1, and a bias voltage of the positive polarity having a magnitude of Vmax is applied at a time interval t2. When the image area charge formed on the image surface is positive and this is developed by negatively charged toner, the magnitudes of Vmin and Vmax are selected so as to satisfy the relation that $$V_{min} < V_L < V_D < V_{max} \quad (1)$$

where $V_D$ is the image area potential and $V_L$ is the non-image area potential. If so selected, at the time interval t1, the bias voltage Vmin acts to impart a bias field with a tendency to expedite the contact of toner with the image area and non-image area of an electrostatic latent image bearing member and this is called the toner transition stage. At the time interval t2, the bias voltage Vmax acts to impart a bias field with a tendency to cause the toner which is transited to the latent image bearing surface in the time interval t1 to be returned to the toner carrier and this is called the back transition stage.

Figure 1:
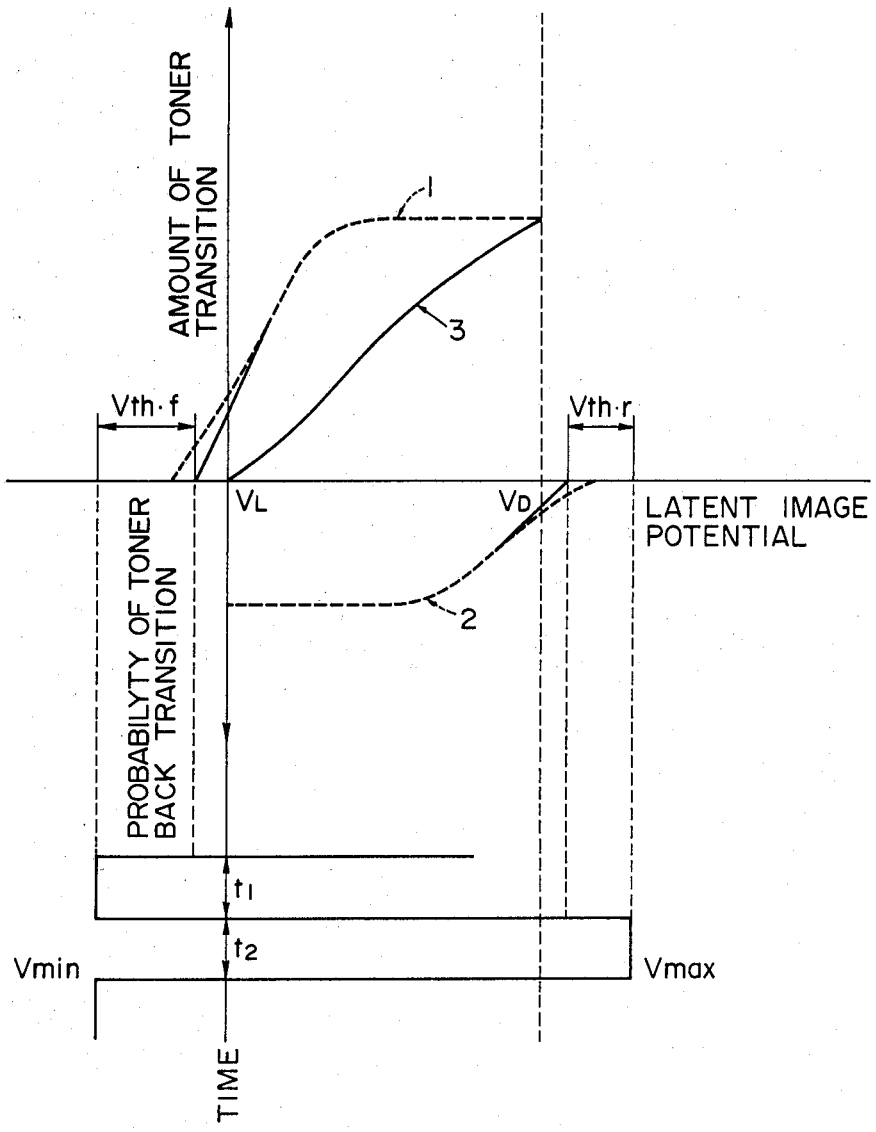
FIG. 1 illustrates the amount of transition of the toner and the characteristic of the degree of toner back transition for the potential of a latent image, as well as an example of the voltage waveform applied.

Vth·f and Vth·r in FIG. 1 are the potential threshold values at which the toner transits from the toner carrier to the latent image surface or from the latent imgage surface to the toner carrier, and may be considered potential values extrapolated by a straight line from the points of the greatest gradient of the curves shown in the drawing. In the upper portion of FIG. 1, the amount of toner transition at t1 and the degree of toner back transition at t2 are plotted with respect to the latent image potential.

The amount of toner transition from the toner carrier to the electrostatic image bearing member in the toner transition stage is such as curve 1 shown by broken line in FIG. 1. The gradient of this curve is substantially equal to the gradient of the curve when no bias alternate voltage is applied. This gradient is great and the amount of the toner transition tends to be saturated at a value intermediate $V_L$ and $V_D$ and accordingly, it is not suited for reproduction of half-tone images and provides poor tone gradation. Curve 2 indicated by another broken line in FIG. 1 represents the probability of toner back transition.

In the developing method according to the present invention, an alternating electric field is imparted so that such toner transition stage and toner back transition stage may be alternately repeated and in the biase phase t1 of the toner transition stage of that alternating electric field, toner is positively caused to temporally reach the non-image area of the electrostatic latent image bearing member from the toner carrier (of course, toner is also caused to reach the image area) and toner is sufficiently deposited also on the half-tone potential portion having a low potential approximate to the light region potential $V_L$, whereafter in the bias phase t2 of the toner back transition stage, the bias is caused to act in the direction opposite to the direction of toner transition to cause the toner which has also reached the non-image portion as described to be returned to the toner carrier side. In this toner back transition stage, as will later be described, the non-image area does not substantially have the image potential originally and therefore, when a bias field of the opposite polarity is applied, the toner which has reached the non-image area as described tends to immdiately leave the non-image area and return to the toner carrier. On the other hand, the toner once deposited on the image area including the half-tone area is attracted by the image area charge and therefore, even if the opposite bias is applied in the direction opposite to this attracting force as described, the amount of toner which actually leaves the image area and returns to the toner carrier side is small. By so alternating the bias fields of different polarities at a preferred amplitude and frequency, the above-described transition and back transition of the toner are repeated a number of times at the developing station. Thus, the amount of toner transition to the latent image surface may be rendered to an amount of transition faithful to the potential of the electrostatic image. That is, there may be provided a developing action which may result in a variation in amount of toner transition having a small gradient and substantially uniform from $V_L$ to $V_D$ as shown by curve 3 in FIG. 1. Accordingly, practically no toner adheres to the non-image area while, on the other hand, the adherence of the toner to the half-tone image areas takes place corresponding to the surface potential thereof, with a result that there is provided an excellent visible image having a very good tone reproduction. This tendency may be made more pronounced by setting the clearance between the electrostatic latent image bearing member and the toner carrier so that it is greater toward the termination of the developing process and by decreasing and converging the intensity of the above-mentioned electric field in the developing clearance.

Figure 2A:
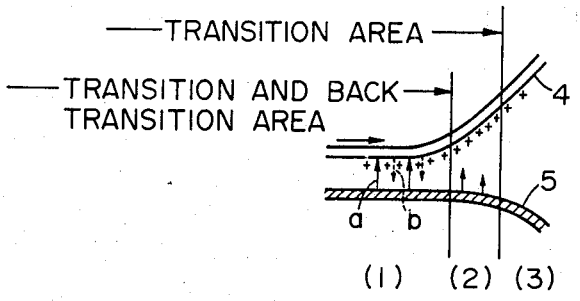
FIGS. 2A and 2B illustrate the process of the developing method according to the present invention.
Figure 2B:
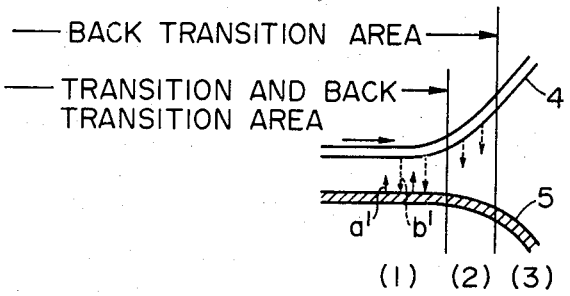
Figure 2C:
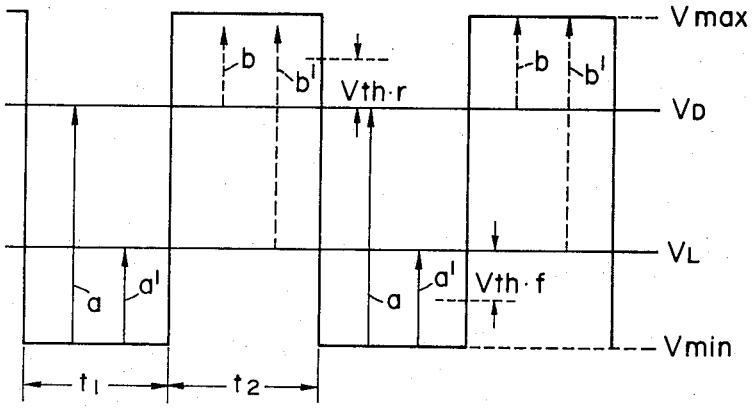
FIG. 2C shows an example of the applied voltage waveform.

An example of such developing process according to the present invention is shown in FIGS. 2A and 2B. As shown in FIGS. 2A and 2B, the electrostatic image bearing member 4 is moved in the direction of arrow through developing regions (1) and (2) to a region (3). Designated by 5 is a toner carrier. Thus, the electrostatic image bearing surface and the toner carrier gradually widen the clearance therebetween from their most proximate position in the developing station. FIG. 2A shows the image area of the electrostatic image bearing member and FIG. 2B shows the non-image area thereof. The direction of arrows shows the direction of the electric fields and the length of the arrows indicates the intensity of the electric fields. It is important that the electric fields for the transition and back transition of the toner from the toner carrier are present also in the non-image area. FIG. 2C shows a rectangular wave which is an example of the waveform of the alternate current applied to the toner carrier, and schematically depicts, by arrows in the rectangular wave, the relation between the direction and intensity of the toner transition and back transition fields. The shown example refers to the case where the electrostatic image charge is positive, whereas the invention is not restricted to such case. When the electrostatic image charge is positive, the relations between the image area potential $V_D$, the non-image area potential $V_L$ and the applied voltages Vmax and Vmin are set as follows:

$$\left.\begin{array}{l}|V_{max} - V_L| > |V_L - V_{min}| \\ |V_{max} - V_D| < |V_D - V_{min}|\end{array}\right\} \quad (2)$$

In FIGS. 2A and 2B, a first process in the development occurs in the region (1) and a second process occurs in the region (2). In the case of the image area shown in FIG. 2A, in the region (1), both of the toner transition field a and the toner back transition field b are alternately applied correspondingly to the phase of the alternate field and the transition and back transition of the toner result therefrom. As the developing clearance becomes greater, the transition and back transition fields become weaker and the toner transition is possible in the region (2) while the back transition field sufficient to cause the back transition (below the threshold value $|V_{th \cdot r}|$) becomes null. In the region (3), the transition neither takes place any longer and the development is finished.

In the case of the non-image area shown in FIG. 2B, in the region (1), both the toner transition field a' and the toner back transition field b' are alternately applied to create the transition and back transition of the toner. Thus, fog is created in this region (1). As the clearance is wider, the transition and the back transition field become weaker and when the region (2) is entered, the toner back transition is possible while the transition field sufficient to cause transition (below the threshold value) becomes null. Thus, in this region, fog is not substantially created and the fog created in the region (1) is also sufficiently removed in this stage. In the region (3), the back transition neither takes place any longer and the development is finished. As regards the half-tone image area, the amount of toner transition to the final latent image surface is determined by the magnitudes of the amount of toner transition and the amount of toner back transition corresponding to that potential, and after all, there is provided a visible image having a small gradient of curve between the potentials $V_l$ to $V_D$, as shown by curve 3 in FIG. 1, and accordingly having a good tone gradation.

In this manner the toner is caused to fly over the developing clearance and is caused to temporally read the non-image area as well to improve the tone gradation, and in order that the toner having reached the non-image area may be chiefly stripped off toward the toner carrier, it is necessary to properly select the amplitude and alternating frequency of the alternate bias voltage applied. Results of the experiment in which the effect of the present invention has clearly appeared by such selection will be shown below.

Figure 3A:
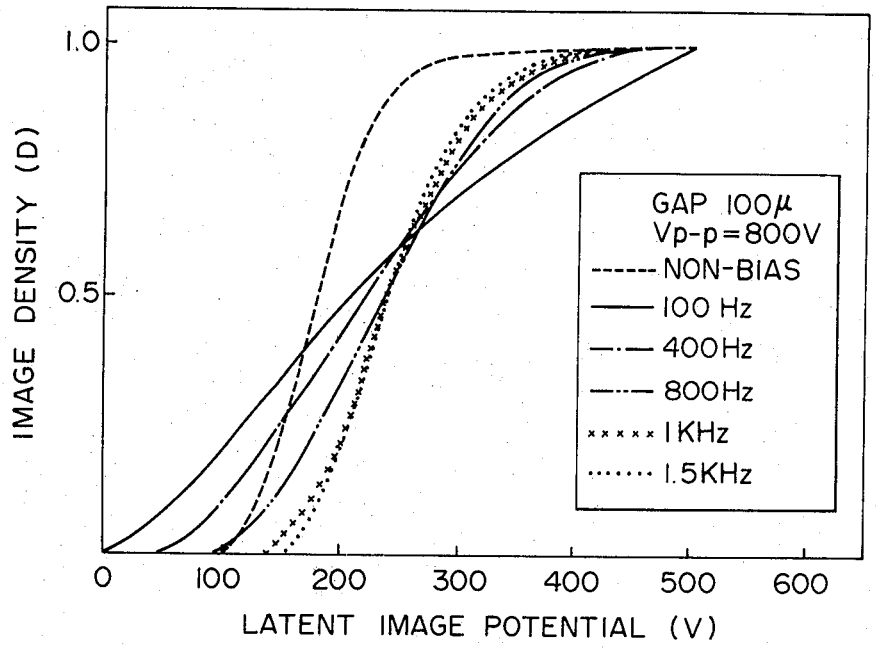
FIGS. 3A and 3B show the characteristic of the electrostatic image potential versus image density as the result of the experiment effected on the developing method according to the present invention, with the frequency of the applied alternate electric field varied.
Figure 3B:
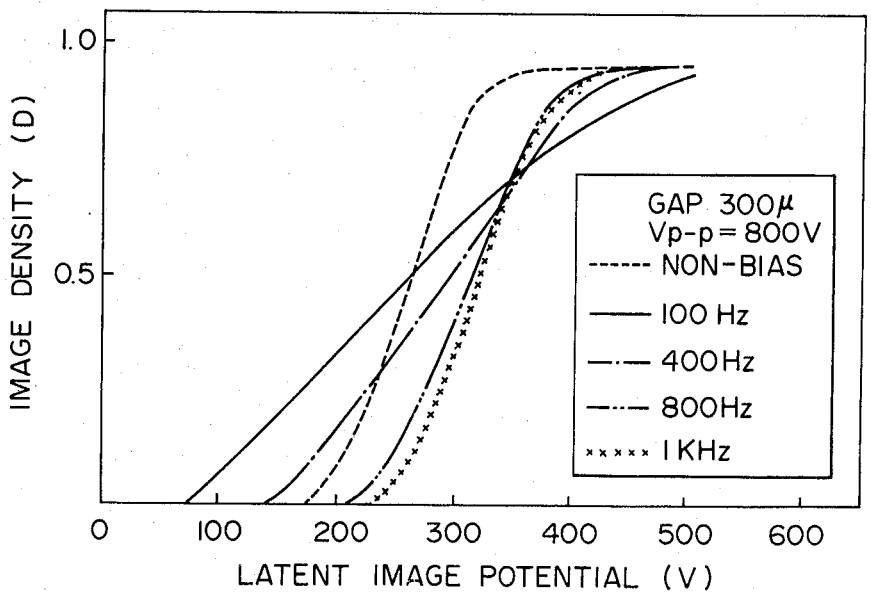

FIGS. 3A and 3B show the plotted results of the measurement of the image relfection density D with respect to electrostatic image potential V, effected with the amplitude of the applied alternate voltage fixed and with the frequency thereof varied. These curves will hereinafter be called the V-D curves. The experiment was carried out under the following construction. A positive electrostatic charge latent image is formed on a cylindrical electrostatic image formation surface. The toner used is a magnetic toner to be described hereinafter (which contains 30% magnetite), and such toner is applied onto a non-magnetic sleeve to a thickness of about 60 μ, the non-magnetic sleeve enveloping therein a magnet, and negative charge is imparted to the toner by the friction between the toner and the sleeve surface. The result when the minimum developing clearance between the electrostatic image formation surface and the magnetic sleeve is maintained at 100 μis shown in FIG. 3A, and the result when such minimum developing clearance is maintained at 300 μ is shown in FIG. 3B. The magnetic flux density in the developing station resulting from the magnet surrounded by the sleeve is about 700 gausses. The cylindrical electrostatic image formation surface and the sleeve are rotated substantially at the same velocity which is about 110 mm/sec. Thus, after having passed through the minimum clearance in the developing station, the electrostatic image formation surface gradually goes away from the toner carrier. The alternate electric field applied to this sleeve comprises a sine wave of amplitude $V_{p\text{-}p}=800$ V (peak-to-peak value) with a DC voltage of +200 V superimposed thereon. FIG. 3 shows the V-D curves when the alternating frequency of the applied voltage is 100 Hz, 400 Hz, 800 Hz, 1 KHz and 1.5 KHz (FIG. 3B only) and the V-D curve when no bias field is applied but conduction occurs through the back electrode of the electrostatic image formation surface and the sleeve.

From these results, it is seen that when no bias field is applied, the gradient or so-called value of the V-D curves is very great but by applying an alternate field of low frequency, the γ value is made smaller to greatly enhance the tone gradation. As the frequency of the extraneous field is increased from 100 Hz, the γ value becomes gradually greater to reduce the effect of enchancing the harmony and, when the clearance is 100 μ and when the frequency exceeds 1 KHz under the amplitude $V_{p\text{-}p}=800$ V, that effect becomes weak; when the clearance is 300 μ and when the frequency reaches the order of 800 Hz, that effect is also reduced; and when the frequency exceeds 1 KHz, the effect of harmony becomes weak. This may be considered to be attributable to the following reason. In the developing process during which an alternate field is applied, when the toner repeats adherence and separation in the clearance between the sleeve surface and the latent image formation surface, finite time is necessary to positively effect the reciprocating movement thereof. Particularly, the toner which transits by being subjected to a weak electric field takes a relatively long time to positively effec the transition.

An electrostatic field exceeding a threshold value which will cause transition of the toner is produced from the half-tone image area, but the electrostatic field is relatively weak. To cause the toner to reach the half-tone image area, it is necessary that the toner particles moved relatively slowly by being subjected to the electrostatic field positively transit to the image area within one-half period of the applied alternate field. For this purpose, where the amplitude of the alternate field is constant, a lower frequency of the alternate field is more advantageous and accordingly, as shown by the results of the experiment, a particularly good tone gradation is provided for an alternate field of low frequency. This speculation is justified by the comparison between the results of the experiment shown in FIGS. 3A and 3B. The results shown in FIG. 3B have been obtained under the same conditions as those shown in FIG. 3A except that the clearance between the electrostatic image formation surface ad the sleeve surface is as great as 300 μ. The wider clearance results in a lower intensity of the electric field to which the toner is subjected. The wider clearance further results in a longer distance of jump and after all, longer time of transition.

As is actually apparent from FIG. 3B, the $\gamma$ value becomes considerably great for the order of 800 Hz and when 1 KHz is exceeded, the $\gamma$ value becomes almost equal to that when no alternate voltage is applied. Therefore, in order to obtain the same effect of enhanced tone reproduction as that when the clearance is narrow, it is preferable to reduce the frequency as will later be described or to increase the intensity (amplitude) of the alternate voltage.

On the other hand, too low a frequency does not result in sufficient repetition of the reciprocating movement of the toner during the time the latent image formation surface passes through the developing station, and tends to cause irregular development to be created in the image by the alternate voltage. As the result of the foregoing experiment, generally good images have been provided down to the frequency of 40 Hz, and when the frequency is below 40 Hz, irregularity has been created in the visible image. It has been found that the lower limit of the frequency for which no irregularity is created in the visible image depends on the developing conditions, above all, the developing speed (also referred to as the process speed, $V_p$ mm/sec.). In the present experiment, the velocity of movement of the electrostatic image formation surface has been 110 mm/sec. and therefore, the lower limit of the frequency is $40/110 \times V_p \approx 0.3 \times V_p$. As regards the waveform of the alternate voltage applied, it has been confirmed that any of sine wave, rectangular wave, sawtooth wave or asymmetric wave of these is effective.

Such application of the alternate bias, of lower frequency brings about remarkable enhancement of the tone gradation, but the voltage value thereof must be properly set. That is, too great a value for the $|V_{min}|$ of the alternate bias may result in an excessive amount of toner adhering to the non-image area during the toner transition stage and this may prevent sufficient removal of such toner in the developing process, which in turn may lead to fog or stain created in the image. Also, too great a value for $|V_{max}|$ would cause a great amount of toner to be returned from the image area, thus reducing the density of the so-called solid black portion. To prevent these phenomena and to sufficiently enhance the tone gradation, Vmax and Vmin may preferably and reasonably be selected to the following degrees:

$$V_{max} \approx V_D + |V_{th \cdot r}| \quad (3)$$

$$V_{min} \approx V_L + |V_{th \cdot f}| \quad (4)$$

$V_{th \cdot f}$ and $V_{th \cdot r}$ are the potential threshold values already described. If the voltage values of the alternate bias are so selected, the excess amount of toner adhering to the non-image area in the toner transition stage and the excessive amount of toner returned from the image area in the back transition stage would be prevented to ensure obtainment of proper development.

Figure 4A:
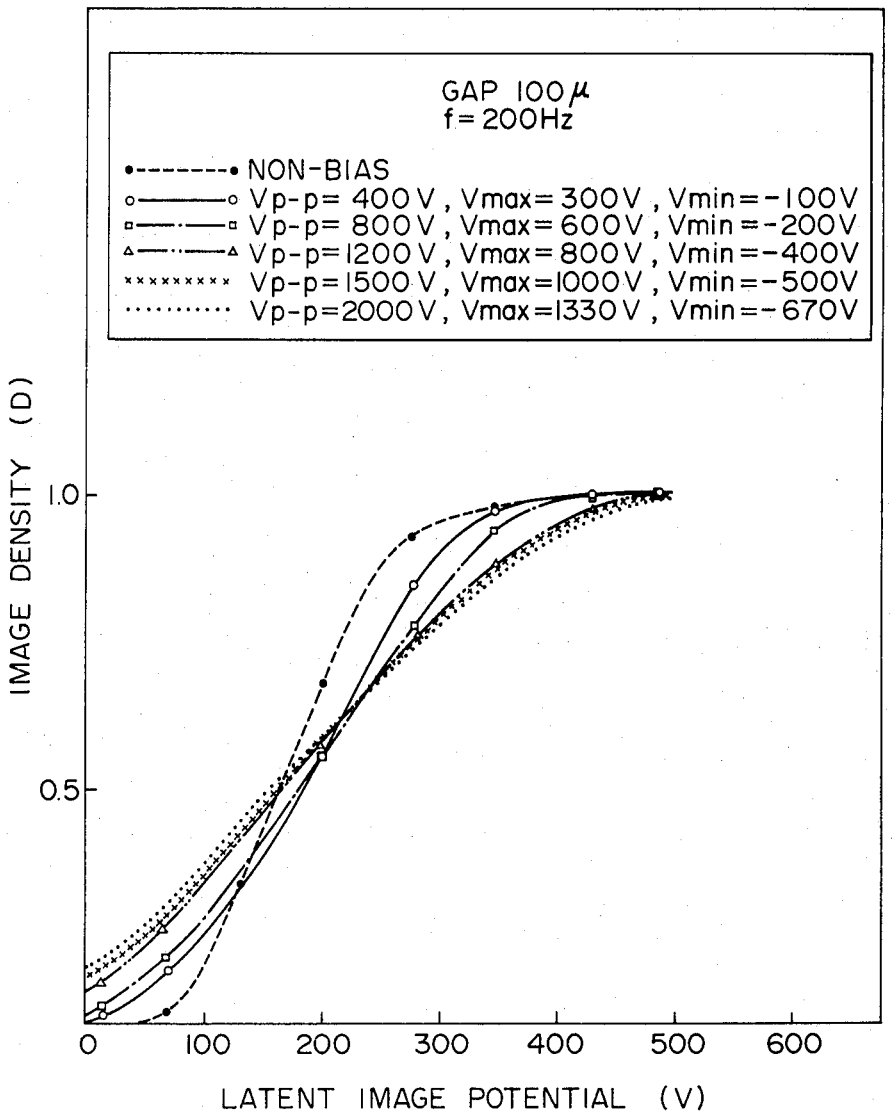
FIGS. 4A and 4B show the characteristic of the electrostatic image potential versus image density as the result of the experiment effected on the developing method according to the present invention, with the amplitude of the applied alternate electric field varied.
Figure 4B:
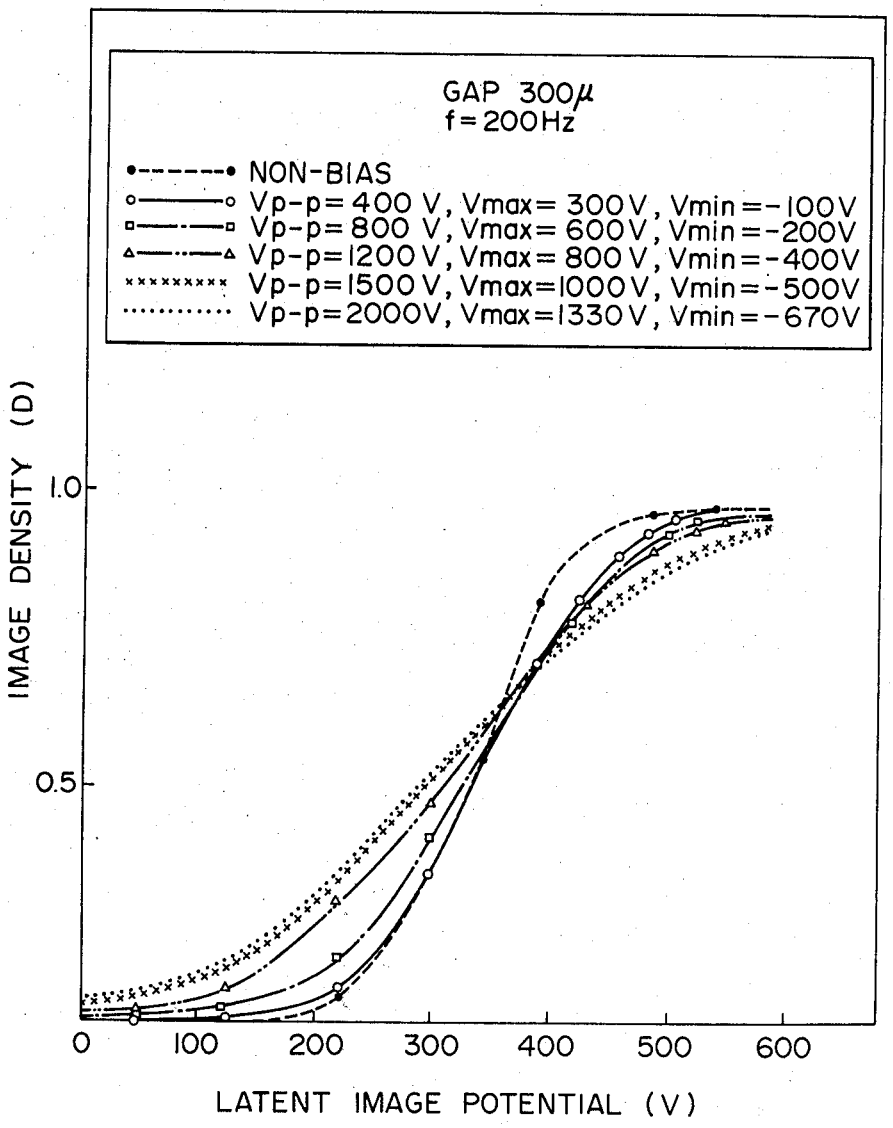

This is shown by the results of the experiment. FIGS. 4A and B show the V-D curves when the amplitude $V_{p-p}$ of the alternate field is varied with the frequency thereof fixed (200 Hz). FIG. 4A shows the result in the case where the developing clearance is set to 100 $\mu$, and FIG. 4B shows the result in the case where the developing clearance is set to 300 $\mu$. The other conditions are the same as those in FIGS. 3A and B. First, when the developing clearance is relatively small, and when the amplitude $V_{p-p}$ exceeds 400 V, the result of enchanced tone gradation appears as compared with the case where no electric field is applied. When the $V_{p-p}$ exceeds 1500 V, the tone gradation is good but fog beings to appear in the non-image area, and when the $V_{p-p}$ exceeds 2000 V, more fog appears. Prevention of such fog may be accomplished by increasing the alternating frequency to higher than 200 Hz.

A wider developing clearance of 300 $\mu$ has given rise to the effect of enhanced tone gradation from $V_{p-p}=400$ V or higher and has given birth to visible images of good quality having good tone gradation and free of fog for the order of 800 V of the $V_{p-p}$. If the $V_{p-p}$ exceeds 2000 V, the tone gradation is good but fog is created and therefore, in such a case, it is necessary to increase the alternating frequency.

When the developing clearance d is relatively great like this, it is advisable to provide a greater value of the $V_{p-p}$ of the applied voltage and providing a higher value for f than when the developing clearance d is small.

In order to provide enhanced tone gradation of the image, it is necessary to set the alternating frequency and amplitude value of the applied alternate voltage to proper ranges, and it has been found that, depending on the properties of the image, the relation between the frequency and amplitude value of the applied voltage may be selectively changed over within an appropriate range. That is, when the relation between the frequency and the voltage value of the alternate voltage are studied more strictly, it has become clear that the developing characteristic (V-D curves) can be selected arbitrarily by those values. An example of it is shown in FIG. 5.

Figure 5:
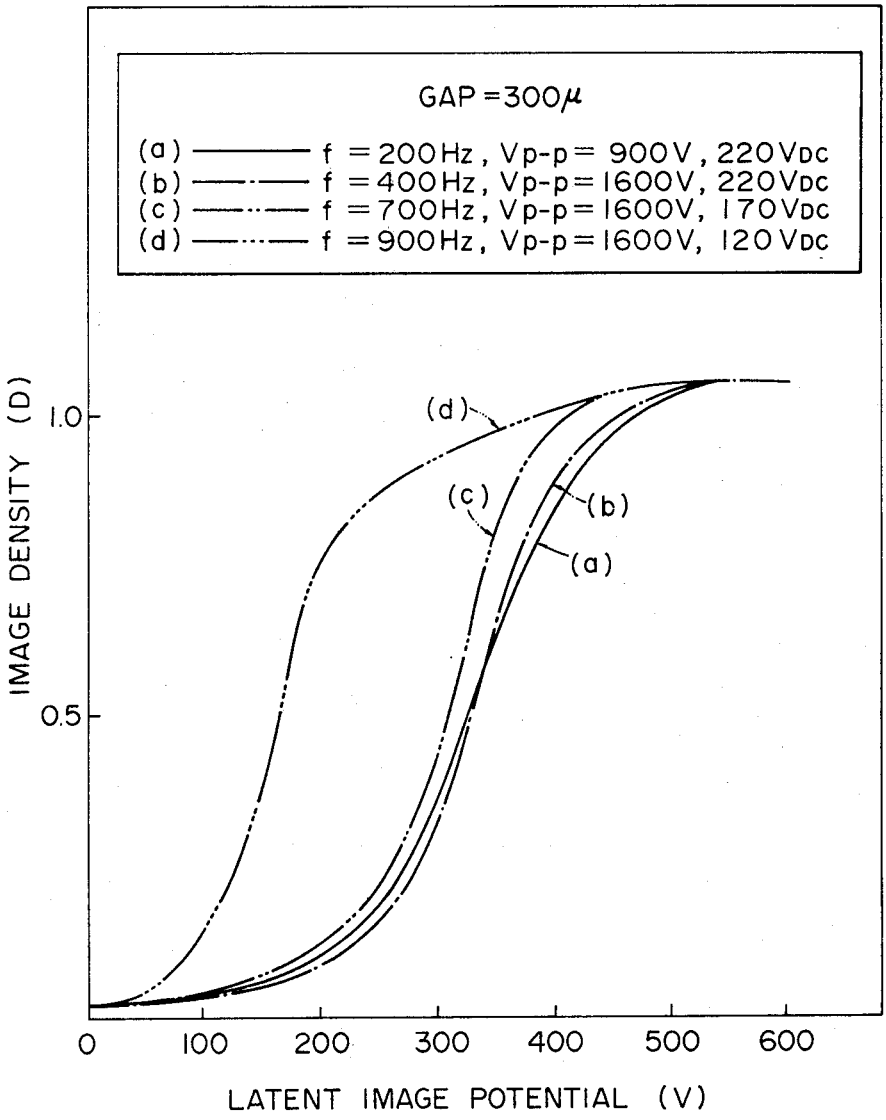
FIG. 5 shows the characteristic of the electrostatic image potential versus image density as the result of the experiment effected on the developing method according to the present invention, with the frequency and amplitude of the applied alternate voltage varied.

FIG. 5 shows the developing characteristic when the clearance between a photosensitive drum which is the latent image bearing member and a sleeve which is the developer carrier is 300 $\mu$, the thickness of the developer layer on the sleeve is about 100 $\mu$, and the toner used comprises 100 parts of styrene acryl resin, 60 parts of ferrite, 2 parts of carbon black and 2 parts of auriferous dye as the charge controlling agent mixed together and ground and having extraneously added thereto 0.4% by weight of colloidal silica. The conditions of each curve shown there are the bias conditions (alternating frequency f (Hz), amplitude value ($V_{p-p}$)) for visualizing the dark region potential (about 500 V) at the light region potential of about OV. The applied voltage waveform comprises a sine wave with a DC voltage superimposed thereon. (The slight difference of this graph from the foregoing graph is attributable to the difference between the developers used.)

As is apparent from FIGS. 3A and B and the graph of FIG. 5, when the frequency f is low, there is usually obtained a developing characteristic having high tone gradation and when the frequency f is slightly high, there is obtained a developing characteristic having a great value for $\gamma$. By varying the amplitude of the alternate voltage in addition to such variation in frequency, it is possible to obtain any desired developing characteristic corresponding to the kind of the image. (The DC component is also varied slightly.)

The curve (a) shown in FIG. 5 is the VD curve when the frequency f is 200 Hz, $V_{p-p}=900$ V and the superimposed DC component is 220 V, and it is seen therefrom that this bias condition has a good tone gradation. The curve (b) is the VD curve when the frequency and the amplitude value have been increased to f=400 Hz and $V_{p-p}=1600$ V, respectively, with a DC component of 220 V, and it is some what greater in r than the curve (a) but still has a relatively high tone gradation.

If, with respect to the curve (b), the frequency is increased to 700 Hz and 900 Hz with the amplitude $V_{p-p}$ maintained constant (the superimposed DC voltage is decreased), the $\gamma$ becomes greater and greater as indicated by the curves (c) and (d), thus resulting in poor tone gradation. On the other hand, however, as shown by the curve (d), it can be seen that even if the electrostatic image potential is low, good development as that potential is possible. Further, although the tone gradation is poor, the so-called edge effect becomes great to provide good reproducibility of the line image and reduced fog.

By varying the bias conditions, it is possible to ensure all-round quality of image corresponding to the original or to the liking of the user.

Figure 6:
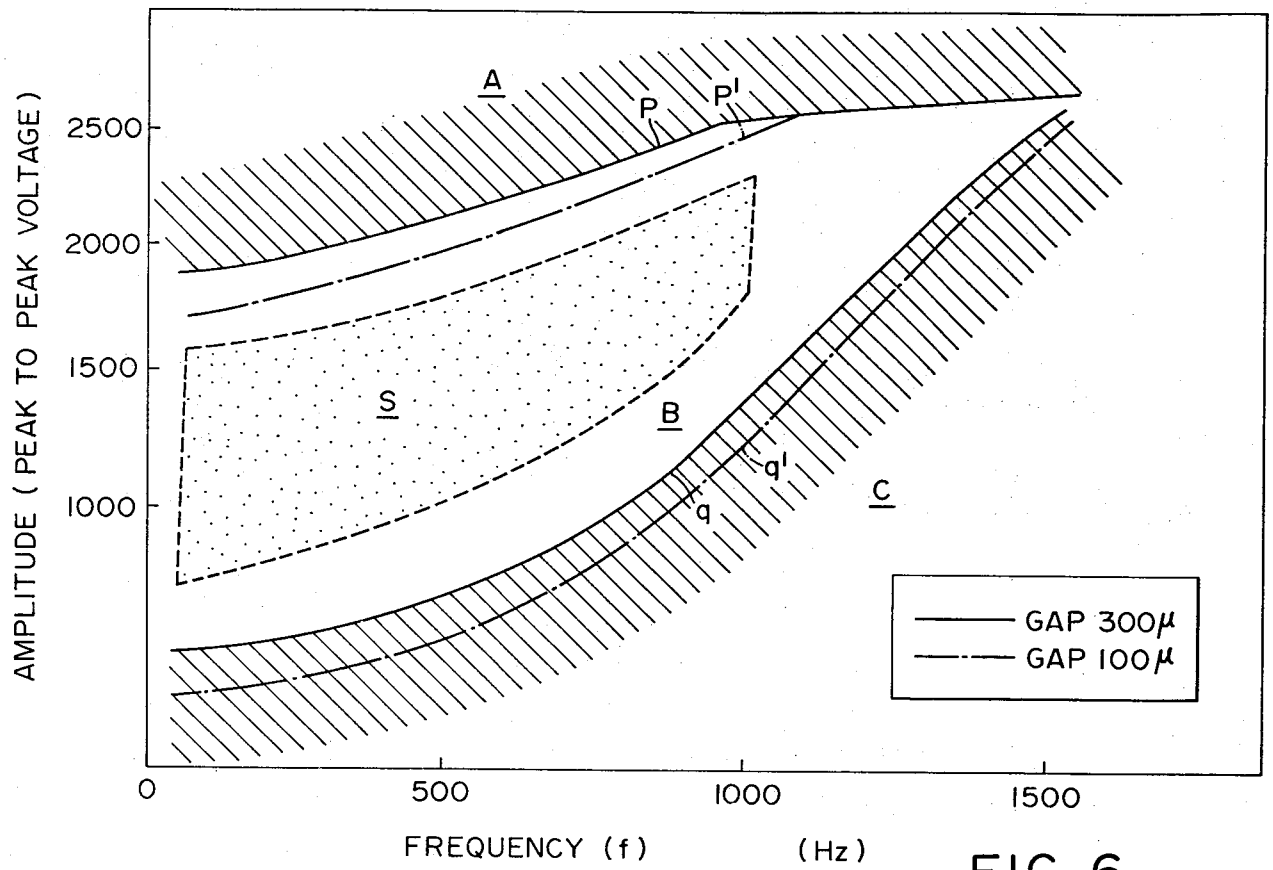
FIG. 6 is a graph illustrating the range of selection of the amplitude versus frequency of the applied alternate electric field as the result of the experiment effected on the developing method according to the present invention.

A preferable range of combination between the alternating bias conditions (frequency f (Hz) and amplitude value $V_{p-p}$(V)) on the basis of each experiment is shown in FIG. 6. FIG. 6, with the ordinate representing the amplitude $V_{p-p}$(V) of the applied voltage and the abscissa representing the alternating frequency f (Hz) thereof, shows a referable range of combination between the two selectable in accordance with the image.

In FIG. 6, the solid-line curve p indicates the boundary at which fog relatively tends to appear when the developing clearance is 300 $\mu$, and the shaded area A indicates a range in which the fog tends to appear and which is not suited for the line copy. Also, the solid-line curve q indicates the boundary at which the quality of the tone gradation is judged when the developing clearance is 300 $\mu$, and the shaded area C indicates a range in which the effect thereof is low. Thus, the range B surrounded by the two curves p and q is a range in which fog is reduced and the image is excellent in definition and tone gradation.

Of course, the positions of these curves p and q may be more or less varied by a variation in size of the developing clearance d. When d is relatively small, the curves p and q become displaced to dot-and-dash line positions p' and q', respectively.

Particularly, in the area encircles by a broken line S, the overall effect of the bias by the alternate field of low frequency is pronounced. The lower limit value of the frequency in this area S is a value determined by the previously mentioned relation that $f \geqq 0.3 \times V_p$, and the upper limit value thereof is determined with a view to well maintain the SN ratio. This SN ratio will now be described. When the frequency of the applied alternate field is increased as mentioned previously, it is necessary to make the amplitude $V_{p-p}$ of the applied voltage great to order to ensure the reciprocal movement of the developer (the movement of the developer which temporally reaches the non-image area, also) to take place between the developer carrier and the latent image bearing member. However, when such a voltage value high, it is much higher than the potential difference ($V_D$) of the image area to be visualized and the transition phenomenon of the developer to the image area can hardly sense the potential difference $V_D$. If so, the definition of the image becomes reduced so that the line reproducibility becomes poor and the fog becomes ready to appear. In addition, the use of a high voltage (higher than about 2500 V) in particular tends to cause the discharging phenomenon with respect to neighboring members and this leads to a problem in constructing an apparatus.

Therefore, under the above-described standard set conditions, the amplitude may preferably be $V_{p-p} \leqq 2500$ V, and particularly preferably be $V_{p-p} \leqq 2000$ V, and the frequency may particularly preferably be $f \leqq 1$ KHz. Depending on the combination with the amplitude, the frequency may practically be $f \leqq 1.5$ KHz to thereby obtain the intended effect.

As has hitherto been described, the application of an extraneous alternate voltage between the latent image formation surface and the toner carrier leads to remarkably enhanced tone gradation of the image and prevention of fog. Further, by using magnetic toner as the developer and a sleeve enclosing a permanent magnet as the developer carrier and by properly setting the extraneous alternate voltage value, as will hereinafter be described, it is possible to further enhance the reproducibility of line images at the same time.

Figure 7:
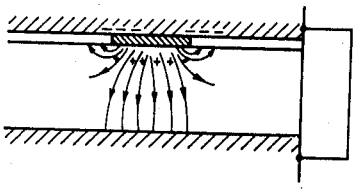
FIG. 7 PRIOR ART
FIG. 7 illustrates the electric lines of force produced from the electrostatic image in the developing method according to the prior art.

Description will hereinafter be made with the electrostatic image formation charge as being positive, whereas the invention is not restricted thereto. In the so-called toner transfer developing method, the electric line of force produced from the end of the latent image goes around the back electrode of the latent image formation surface as shown in FIG. 7 and cannot reach the surface of toner carrier, and accordingly the toner which has started from the toner carrier can hardly adhere to the end of the image. Thus, the resultant image tends to suffer from thinning of lines and poor sharpness of the end, which in turn offers a problem in line copying.

Figure 8:
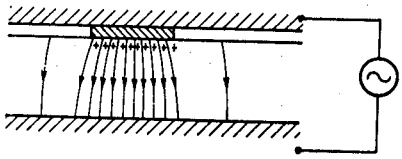
FIG. 8 illustrates the electric lines of force produced from the electrostatic image in the developing method according to the present invention.

Therefore, in this system, if an alternating bias is applied and if the Vmin thereof is selected to a sufficiently low value, the electric line of force in the developing station during the toner transition stage goes so little around the end of the electrostatic image, as shown in FIG. 8, that there are formed parallel electric fields. This enables the toner to positively adhere to the end of the electrostatic image. However, as already noted, too low a value for Vmin would usually cause fog or stain to be created in the non-image area.

In the present embodiment of the invention, the advantage resulting from the use of the magnetic toner as the developer and the sleeve enclosing the permanent magnet as the developer carrier lies chiefly in solving this problem. By properly setting the content of the magnetic material in the developer and the intensity of the magnetic field of the permanent magnet, it is possible to uniformly enhance the restraining force of the toner onto the sleeve and accordingly select the value of $|Vth \cdot f|$ to a sufficiently great value. As the result, Vmin can be set to a low value with the amount of the toner adhering to the non-image area during the toner transition stage being minimized.

Thus, by applying an alternating bias in the toner transfer developing method using magnetic toner, it is possible to obtain images of good tone gradation which are clear at the end and free of fog and which are excellent also in line copying.

On the other hand, it is a very difficult problem to convey the developer to the developing station in the high resistance toner transfer development and to impart a charge. The method using magnetic toner as the developer and conveying the developer by means of a sleeve and imparting a charge by frictional charging between the sleeve surface or an applicator member and the toner is considered to be one very advantageous methods.

Also, application of the magnetic toner onto the sleeve may be effected by a method of urging a resilient member against the sleeve or a method of maintaining a magnetic member in opposed relationship with the magnetic pole of the permanent magnet within the sleeve and in non-contact with the sleeve surface and controlling the thickness of the magnetic toner by the magnetic force. In the conventional toner transfer development wherein development is effected with the sleeve opposed to the electrostatic image bearing member and with these two members being rotated in the same direction and at the same velocity, the state of the toner applied onto the sleeve directly affects the quality of image and when the application of the toner is effected by the former method, the status of application is relatively delicate and ensures a good quality of image. In this method of application, however, the toner strongly rubs against the sleeve surface and therefore the resin content of the toner adheres to the sleeve surface to remarkably prevent the toner from being charged.

Figure 9A:
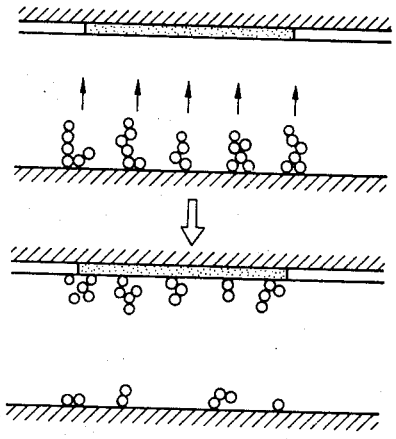
FIGS. 9A and 9B illustrate the movement of the developer.

On the other hand, if the latter method is used, the adherence of the toner to the sleeve surface is minimized but the status of the toner applied onto the sleeve surface presents scattered lumps of toner particles and is coarse and accordingly, the image after developed becomes coarse as shown in FIG. 9A.

Figure 9B:
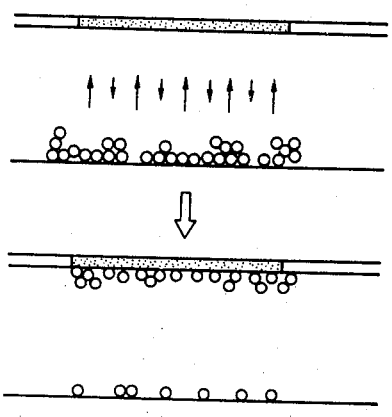

In contrast, by applying an alternate bias in the developing station according to the present invention, toner particles are caused to effect reciprocal movement between the latent image and the sleeve surface and are separated into individual particles in that process, so that the toner can finely adhere to the image area of the electrostatic image surface as shown in FIG. 9B.

Some specific examples will be shown below in detail.

EXAMPLE (1)

Figure 10:
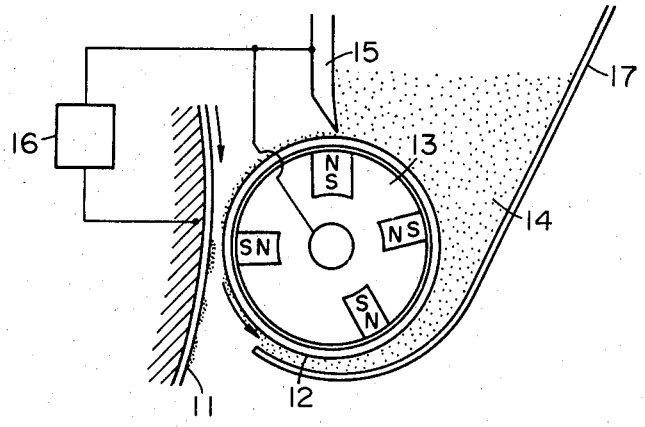
FIGS. 10 and 12 illustrate embodiments of the developing method according to the present invention.

An example of the construction of the developing device for carrying out the developing method of the present invention is shown in FIG. 10.

Designated by 11 is a photosensitive drum having an insulating layer or a CdS layer. Denoted by 12 is a non-magnetic (stainless) sleeve. These two members 11 and 12 are rotated at the same peripheral velocity of 110 mm/sec. and in the same direction. The diameters of the members 11 and 12 are 80 mm and 30 mm, respectively, and the two members are maintained with a maximum clearance of 200 μ and form a developing station adjacent thereto. The two members are so configured that with their rotation, they necessarily pass through the most proximate position and then the clearance therebetween gradually becomes larger.

Designated by 13 is a permanent magnet fixed within the sleeve. Reference numeral 14 denotes a magnetic toner which will hereinafter be described, and 15 a magnetic (iron) blade for uniformly applying the toner onto the sleeve. The composition of the magnetic toner used in the present Example is as follows:

| | |
|---|---|
| polystyrene | 60 wt % |
| magnetite | 35 wt % |
| carbon black | 5 wt % |
| negative charging control agent (spyron) | 2.5 wt % |
| Colloidal silica (extraneously added) the weight ratio to the toner | 0.2 wt % |

A member 15 is installed in opposed relationship with the magnetic poles of the member 13 with a clearance of 180 μ maintained between the end thereof and the member 12. The magnetic field at the end of the member 15 is about 1000 G. The magnetic toner 14 is controlled to a thickness of about 70 μ by the member 15 and conveyed to the developing station while being imparted a negative charge by the friction between the toner and the surface of the member 12. The members 12 and 15 are maintained electrically conductive to prevent discharging therebetween, and an alternate voltage is applied to the electrically conductive support member for the member 11 by a power source 16. The frequency of the alternate voltage is 200 Hz and applied in the form of a sine wave of amplitude $V_{p\text{-}p}=800$ V with a DC voltage +200 V superimposed thereon. The electrostatic image potential is +500 V for the image area and OV for the non-image area. A member 17 is a toner container formed of plastics.

Under the above-described construction, there could be provided images of good tone gradation which were free of fog and clear.

EXAMPLE (2)

Figure 11:
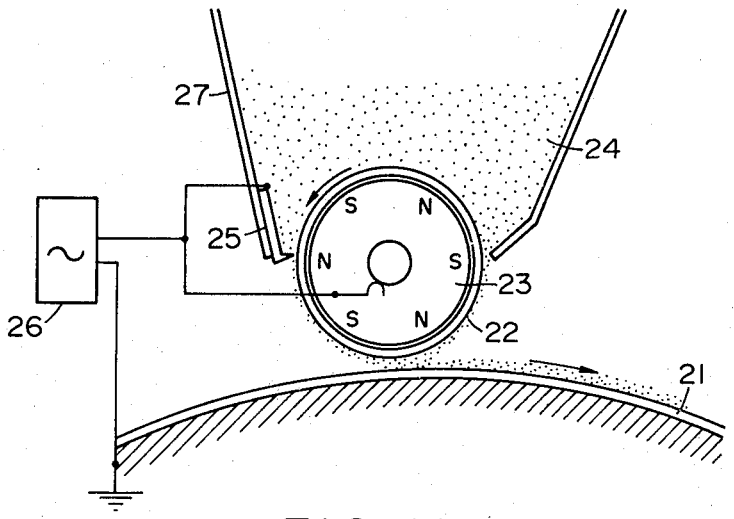

The construction of the developing device for carrying out another developing method of the present invention is shown in FIG. 11.

Designated by 21 is a photosensitive drum having an insulating layer on a CdS layer. Denoted by 22 is an aluminum sleeve. The members 21 and 22 are rotated substantially at the same peripheral velocity of 400 mm/sec. and in the same direction. The diameters of the members 21 and 22 are 200 mm and 50 mm, respectively, and the two members are held with a minimum clearance of 300 μ and form a developing station adjacent thereto. The two members are so configured that with their rotation, they necessarily pass through the most proximate position and then the clearance therebetween gradually becomes larger.

Designated by 23 is an isotropical permanent magnet fixed within the sleeve, 24 a magnetic toner, and 25 an iron blade for uniformly applying the toner onto the sleeve.

The composition of the magnetic toner used in the present Example is as follows:

| | |
|---|---|
| polyester resin | 73 wt. % |
| ferrite | 25 wt. % |
| carbon black | 2 wt. % |
| colloidal silica | 0.3 wt. % (extraneously added) |

The member 25 is installed at a position opposed to the magnetic poles of the member 23 with a clearance of 250 μ maintained between the end thereof and the member 22. The magnetic field at the end of the member 25 is about 750 G. The magnetic toner 24 is controlled to a thickness of about 120 μ by the member 25 and is conveyed to the developing station while being imparted a negative charge by the friction between the toner and the surface of the member 22. The developing station is opposed to between the magnetic poles of the magnet within the sleeve. A member 27 is a toner container.

The member 22 and the member 25 are maintained electrically conductive to prevent discharging therebetween and an alternate voltage is applied to the conductive support member for the member 21 by a power source 26. The frequency of the alternate voltage is 400 Hz and the alternate voltage is applied in the form of a sine wave of amplitude $V_{p-p}=1200$ V with a DC voltage +200 V superimposed thereon. The electrostatic image potential is +350 V for the image area and −20 V for the non-image area.

Under the above-described construction, there could be provided images of good tone gradation which were free of fog and clear.

EXAMPLE (3)

Figure 12:
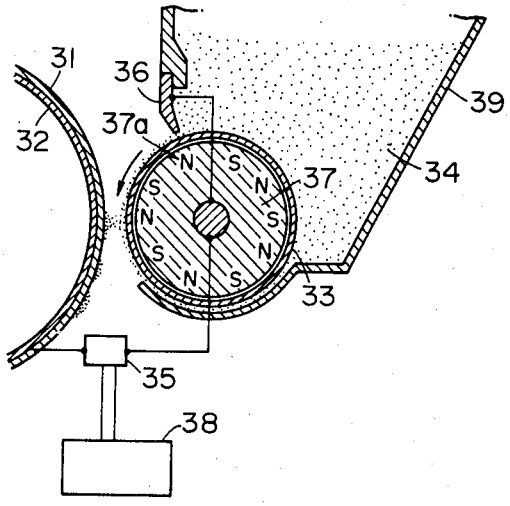

In FIG. 12, reference numeral 31 designates an electrostatic latent image bearing member having an insulating layer on a CdS layer, and 32 a back electrode thereof. The members 31 and 32 form a drum shape. Designated by 33 is a non-magnetic stainless metal sleeve having a magnet roll 37 therewithin. The electrostatic latent image bearing member 31 and the sleeve 33 are held with the minimum clearance therebetween maintained at 300 μ by a well-known clearance maintaining means. Designated by 34 is a one-component magnetic developer in a developing container 39. The developer comprises 70% by weight of styrene maleic acid resin, 25% by weight of ferrite, 3% by weight of carbon black and 2% by weight of negative charge controlling agent mixed and ground and further has 0.2% by weight of colloidal silica extraneously added thereto to enhance the fluidity thereof. Designated by 36 is an iron blade opposed to the main pole 37*a* (850 gausses) of a magnet roll 37 enclosed in a sleeve 33. The iron blade controls the thickness of the magnetic developer 34 applied onto the sleeve 33 by a magnetic force. The clearance between the blade 36 and the sleeve 33 is maintained at about 240 μ and the thickness of the developer layer applied onto the sleeve 33 by the blade 36 is about 100 μ. Designated by 35 is a variable alternate voltage source and the voltage therefrom is applied to between the back electrode 32 and the conductive portion of the sleeve 33. The blade 36 and the sleeve 33 are at the same potential to prevent irregularity of application of the developer.

The average value of the electrostatic image potential is +500 V for the image area and 0V for the non-image area. The extraneous alternate voltage comprises a sine wave of frequency 400 Hz and peak-to-peak 1500 V rendered into a distorted sine wave having an amplitude ratio of about 1.9:1 between the positive phase and the negative phase (this will further be described). Again by this embodiment, it was possible to obtain visible images of good quality which were excellent in tone gradation and which were clear and free of fog.

Figure 13A:
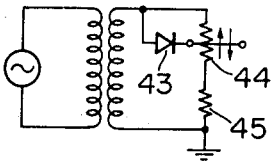
FIG. 13A is a diagram of the output circuit of the alternating voltage applicable to the embodiment shown in FIG. 12.
Figure 13B:
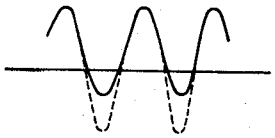
FIG. 13B shows the output waveform thereof.

An example of the circuit for providing such a distorted sine wave is shown in FIG. 13A. FIG. 13B illustrates the distorted output wave of such circuit.

The circuit of FIG. 13A produces the distorted sine wave as shown in FIG. 13B by reducing only the negative (−) side of the sine wave alternating voltage by means of a diode 43 and resistors 44, 45, and if the resistor 44 of the output terminal 0 is caused to slide, the negative (−) side voltage may be made variable. This circuit construction enables the circuit to be formed more easily than the DC superimposed type.

Again by this embodiment, there was provided a development which was free of fog and excellent in tone gradation.

EXAMPLE (4)

Figure 14:
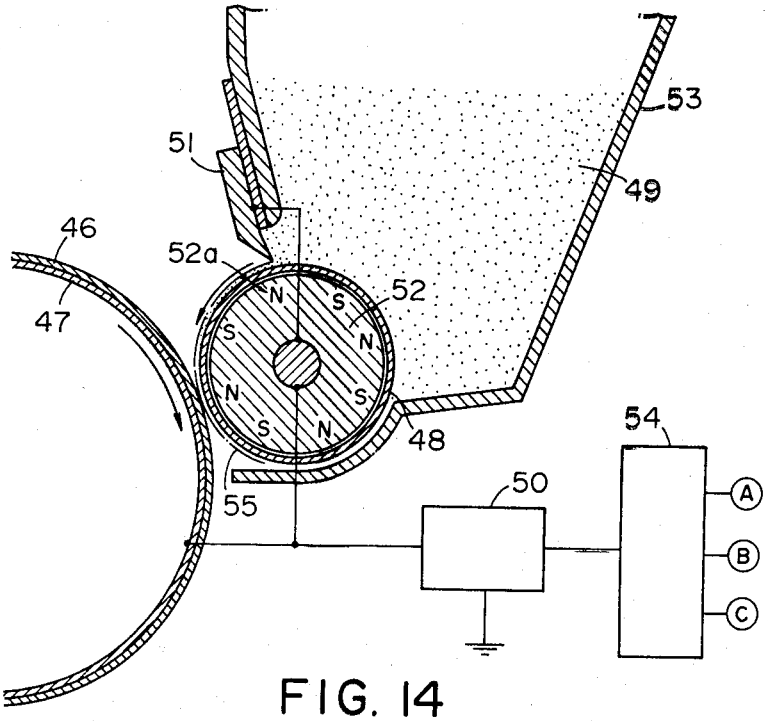
FIG. 14 illustrates a further embodiment of the developing method according to the present invention.

In FIG. 14, 46 is an electrostatic latent image bearing member having an insulating layer on a CdS layer, and denoted by 47 is a back electrode thereof. The members 46 and 47 form a drum shape. Reference numeral 48 denotes a non-magnetic stainless metal sleeve having a magnet roll 52 therewithin. The electrostatic latent image bearing member 46 and the sleeve 48 are held with the minimum clearance therebetween maintained at 300 μ by well-known clearance maintaining means 55. Denoted by 49 is a one-component magnetic developer in a developing container 53. The developer comprises 70% by weight of styrene maleic acid resin, 25% by weight of ferrite, 3% by weight of carbon black and 2% by weight of negative charge controlling agent auriferous dye mixed and ground, and further has 0.2% by weight of colloidal silica extraneously added thereto to enhance the fluidity of the developer. Reference numeral 51 designates an iron blade which is opposed to the magnetic pole 52*a* (850 gausses) of the magnet roll 52 enclosed in the sleeve 48, and the blade 51 controls the thickness of the magnetic developer 49 applied onto the sleeve 48 by the magnetic force. The clearance between the blade 51 and the sleeve 48 is maintained at about 240 μ, and the thickness of the developer layer applied onto the sleeve 48 by the blade 51 is about 100 μ. Designated by 50 is a variable alternate voltage source which applies an alternating bias voltage to between the back electrode 47 and the conductive portion of the sleeve 48. To prevent irregularity of application of the developer, the blade 51 and the sleeve 48 are at the same potential.

The average value of the electrostatic image potential was +500 V for the dark area and 0V for the light area. The variable alternate voltage source 50 is set to have respective oscillation sources so that the alternating voltages (a), (b) and (d) applied from the voltage source 50 may be selected from among the four types of voltage shown in FIG. 5. These individual power sources may be of the well-known type. Denoted by 54 is change-over means connected to the voltage source 50 for selecting the frequencies and amplitude values of the alternating voltages (a), (b) and (d). The changeover means may be a known electrical change-over means.

Thus, the operator can select a quality of image corresponding to his liking.

When the selection button A of the selective change-over means 54 shown in FIG. 14 is depressed, the bias condition is set to (a)f=200 Hz, $V_{p-p}=900$ V (DC superimposed 220 V). At this time, the user can obtain a photographic image of delicate quality with a soft tone. When the selection button B is depressed, the bias condition is set to (b)f=400 Hz, $V_{p-p}=1600$ V (DC superimposed 220 V). This condition is used when ordinary copies are to be obtained. When the selection button C is depressed, the bias condition is set to (d)f=900 Hz, $V_{p-p}=1600$ V (DC superimposed 120 V). At this time, the user can reproduce an original which is thin in density and would tend to cause fog, or an original of colored image, or an original which consists chiefly of lines, without fog and at a good quality.

Of course, these selective combinations are only illustrative and if within the above-mentioned proper range, a combination of other frequency and voltage value can of course be adopted.

FIGS. 15A–D to FIGS. 18A–D schematically illustrate the reciprocal movement of the developer in the developing clearance under the low frequency condition which is applied to the developing method of the present invention, and the vibratory movement of the developer when the frequency f of the applied bias voltage is high (for example, 2 KHz or higher). In the results of the experiment shown in FIGS. 3A, B, 5 and 6, the range of frequency preferred for the enhancement of the tone gradation was indicated, and the reciprocal movement of the developer in the above-described embodiment, for example, is schematically illustrated in FIGS. 15A–B and FIGS. 17A–D.

Figure 15A:
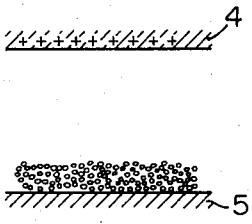
FIGS. 15A-15D to FIGS. 18A-18D illustrate the process of movement and vibration of the developer to the image area and the non-image area in the process of development.
Figure 15B:
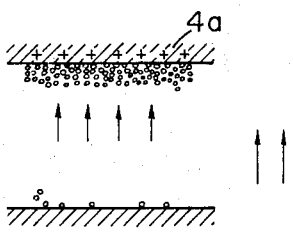
Figure 15C:
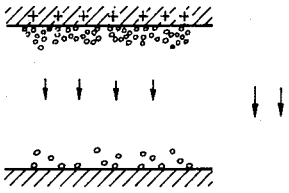
Figure 15D:
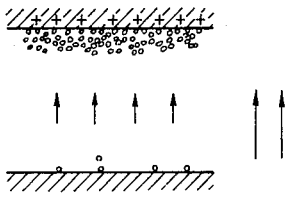

FIGS. 15A–B show the movement of the developer in the clearance between the image area of the latent image bearing member 4 to be visualized and the toner carrier 5, and FIGS. 17A–D show the movement of the developer in the clearance between the non-image area of the latent image bearing member 4 and the toner carrier 5. (A) in these respective Figures shows the initial state in which the bias field is not yet applied. In the toner transition stage shown in (B) of these Figures, more developer transits from the toner carrier 5 to the image area 4*a* due to the electrostatic attraction thereof than in the non-image area. It should be noted that the developer also transits to and reaches the non-image area 4*b* from the toner carrier 5. Arrows indicate the direction of movement of the developer. Next, in the toner back transition stage wherein the applied field assumes the opposite phase as shown in (C) of these Figures, a relatively small amount of developer returns to the toner carrier from the image area, but in the non-image area there is no charge which attracts the toner, so that almost all of the developer which has transited at the toner transition stage is returned to the toner carrier in accordance with the reverse bias. Next, when the phase of the bias is again changed, the toner transition stage as shown in (D) of these Figures takes place, and such reciprocal movement of the developer is thereafter repeated in the described manner. Thus, a number of reciprocal movements takes place and in the meantime, the developer is once caused to reach the non-image area also, whereby from the half-tone image area near the light region of relatively low potential to the solid black image area, there is obtained an effect of image visualization faithful to the potential held thereby.

As shown in the embodiments, the latent image bearing member is in the form of a drum and the toner carrier is a sleeve, so that with the rotation of these two members in the same direction, the opposed portions of the two members provide a gradually widening clearance from their most proximate position and the intensity of the bias alternate field acting on this clearance is gradually reduced and converged to complete the development. Therefore, in this converging stage, the tone gradation is very excellent and substantially no developer adheres to the non-image area.

Figure 16A:
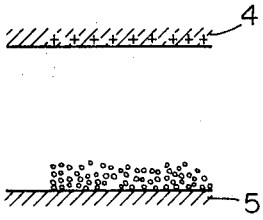
Figure 16B:
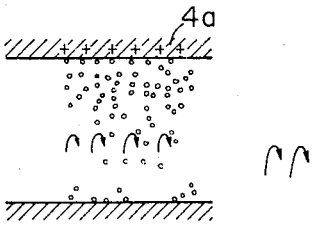
Figure 16C:
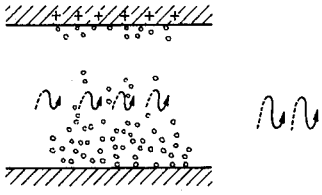
Figure 16D:
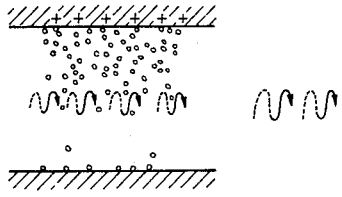
Figure 17A:
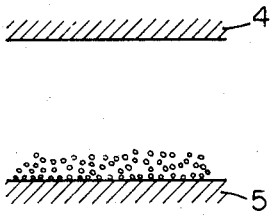
Figure 17B:
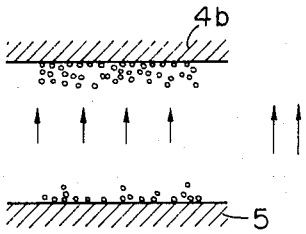

On the other hand, when the alternating frequency is increased to a high frequency, say, 2 KHz or higher, the tone gradation is reduced. This phenomenon will be explained by reference to FIGS. 16A–D and FIGS. 18A–D. (A) in these Figures shows the states of the latent image bearing member 4 and the toner carrier 5 before the application of the bias. When the bias for toner transition is applied to the image area, the toner is liberated from the toner carrier toward the image area 4*a* as shown in FIG. 16B, but there is more or less irregularity in the degree of transition because of the force acting on the individual toner particles and the alternating frequency of the bias is high before this irregularity is converged, so that the reverse bias is applied to the toner which has reached the image area and to the toner which is still suspended in the developing clearance, and it is believed that most of the suspended toner returns to the toner carrier side as shown in FIG. 16C. When the bias phase is again reversed before this return movement of the toner is terminated, the toner is again subjected to the bias force directed toward the image area. Accordingly, not the reciprocal movement but the vibration of the toner is taking place in the clearance between the image area and the toner carrier.

Figure 18A:
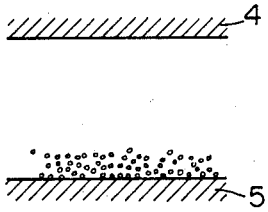
Figure 18B:
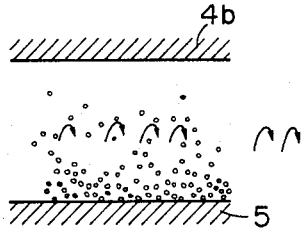
Figure 17C:
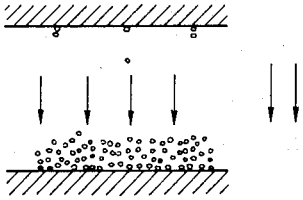
Figure 18C:
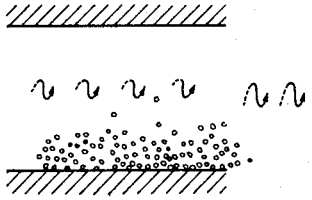
Figure 17D:
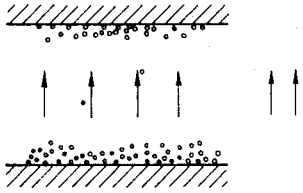
Figure 18D:
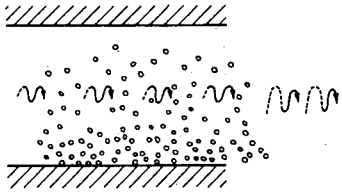

Such vibratory movement of the toner is pronounced in the clearance between the non-image area in which no latent image charge is present and the toner carrier. This state is shown in FIGS. 18A–D. From the initial state shown in FIG. 18A, a bias phase for toner transition is applied. In this case, when a bias exceeding the transition threshold value is applied, the toner is liberated from the toner carrier but since the alternating frequency of the bias is high as shown in FIG. 18B, the phase of the bias is reversed before the toner reaches the non-image area 4*b*, and the toner returns to the toner carrier (FIG. 18C). Next, when the toner transition bias is applied, the toner is again liberated from the toner carrier but during the time the toner is being suspended in the aforementioned clearance, the reverse bias is again applied so that the toner goes toward the toner carrier as shown in FIG. 18D. In this manner, the toner vibrates in the clearance and substantially does not reach the non-image area 4*a*, so that there is no toner adhering to the non-image area even when the development has been terminated, thus avoiding formation of the so-called fog. However, on the other hand, it is believed that the adherence of the toner to a region having a half-tone image potential which is approximate to the light region (the non-image area) does not sufficiently take place, thus reducing the tone gradation. This phenomenon is theoretically considered to take place until a certain degree of high frequency exceeding 2 KHz is reached, and this would raise a difficulty in the reproduction of the tone gradation as intended by the present invention.

The foregoing description has been made with respect to the case where the image area potential VD is positive, whereas the present invention is not restricted thereto but it is also applicable to a case where the image area potential is negative and in this latter case, if the positive of the potential is small and the negative of the potential is great, the present invention is equally applicable. Therefore, when such image area charge is negative, the aforementioned formulas (1)–(4) are represented as the following formulas (1')–(4').

$$V\max > VL > VD > V\min \quad (1')$$

$$\left.\begin{array}{l} |V\min - VL| > |VL - V\max| \\ |V\min - VD| < |VL - V\max| \end{array}\right\} \quad (2')$$

$$V\min \approx VD - |Vth \cdot r| \quad (3')$$

$$V\max \approx VL + |Vth \cdot f| \quad (4')$$

The present invention, as has hitherto been described in detail, provides a method which comprises disposing in opposed relationship with each other a latent image bearing member and a non-magnetic developer carrier carrying thereon a layer of magnetic developer and enclosing a magnet therein, with a clearance larger than the thickness of the developer layer maintained in the developing station, and applying an alternate electric field having a phase of a particular polarity which causes the developer to one-sidedly reach both the image area and the non-image area of the latent image bearing member from the developer carrier in the developing clearance and a phase of the opposite polarity from said particular polarity which applies a bias in a direction to cause the developer having reached at least the non-image area to return toward the developer carrier side, thereby effecting development, and an apparatus for carrying out such method.

Thus, the developing method according to the present invention which uses a magnetic developer and in which the transition and back transition of the developer are effected has enabled obtainment of fogless beautiful images having good tone reproduction and clear at the image end portions by the application of an alternate bias field of low frequency.

The present invention is not restricted to the illustrated embodiments, but is applicable to the development of latent images formed by an electrophotographic method, an electrostatic recording method or other image formation method.

The present invention provides a developing method which is characterized by effecting development while applying an alternate electric field in a range satisfying the relation that $$\begin{cases} 400\ \text{V} \leqq V_{p-p} \leqq 2500\ \text{V} \\ 40\ \text{Hz} \leqq f \leqq 1.5\ \text{KHz} \end{cases}$$

where $V_{p\text{-}p}$ represents the amplitude of a preferable low frequency alternating field and f represents the alternating frequency thereof, and an apparatus for carrying out such method. Therefore, by the application of a low frequency alternating field within such range, the transition of the developer to the non-image area and the back transition of the developer to the developer carrier are alternately and positively repeated in the clearance between the developer carrier and the non-image area in the developing station, and such reciprocal movement of the developer may accomplish a development which is highly excellent in reproduction of tone gradation. Further, a layer of magnetic developer is carried on a non-magnetic sleeve enclosing a magnet therein and therefore, the magnetic developer uniformly enhances its restraining force onto the sleeve by the action of the magnetic field, whereby the value of Vth.f which is the potential threshold of the developer transition may be selected to a sufficiently great value, thereby reducing the amount of developer adhering to the non-image area and minimizing the fog.

What we claim is:

1. A dry developing method for developing a latent image comprising the steps of:

defining a developing zone wherein a latent image bearing member having a latent image with an image area and a non-image area, and a non-magnetic conductive member carrying a layer of one component magnetic developer on the surface thereof are disposed in opposed relationship with a clearance between the surface of the latent image bearing member and the surface of the non-magnetic conductive member, the clearance being greater than the thickness of said developer layer so as to create an air gap;

providing a magnetic field in said developing zone;

moving said latent image bearing member and said non-magnetic conductive member; and imparting an alternating electric field sufficient to produce electric fields across said developing clearance which alternate both in the image area and the non-image area.

2. The developing method according to claim 1, wherein said alternating field has a frequency which satisfies the relation $$0.3 \times V_p \leqq f \leqq 1{,}000$$

where $V_p$ represents the surface speed of said latent image bearing member (mm/sec.) and f represents the frequency of said alternating electric field (Hz).

3. The developing method according to claim 1 or 2, wherein said alternating electric field satisfies the relations:

when the image area charge is positive $$|V_{max} - V_L| > |V_L - V_{min}|$$

$$|V_{max} - V_D| < |V_D - V_{min}|$$

and when the image area charge is negative $$|V_{min} - V_L| > |V_L - V_{max}|$$

$$|V_{min} - V_D| < |V_D - V_{max}|$$

where $V_{max}$ represents the maximum value of the alternating electric voltage of said non-magnetic conductive member with a back electrode of said latent image bearing member as the standard, $V_{min}$ represents the minimum value of said voltage, $V_D$ represents the image area potential, and $V_L$ represents the non-image area potential.

4. The developing method according to claim 3, wherein said alternating voltage satisfies the following relations:

when the image area charge is positive, $$V_{min} \approx V_{L-} |Vth{\cdot}f|$$

and when the image area charge is negative, $$V_{max} \approx V_L + |Vth{\cdot}f|$$

where Vth·f represents the potential difference threshold value at which said developer is separated from the surface of said non-magnetic conductive member to transit to said latent image bearing surface.

5. The developing method according to claim 3, wherein said alternating voltage satisfies the following relations when the image area charge is positive, $$V_{max} \approx V_D + |Vth{\cdot}r|$$

and when the image area charge is negative, $$V_{min} \approx V_D - |Vth{\cdot}r|$$

where Vth·r is the potential difference threshold value at which said developer is separated from said latent image bearing surface to transit to said non-magnetic conductive member.

6. The developing method according to claim 1, wherein as a means for applying said developer to said non-magnetic conductive member, a magnetic applicator member is disposed at a position opposed to a pole of the magnet within said non-magnetic conductive member with a clearance of 50 to 500$\mu$ maintained between the end of said magnetic applicator member and the surface of said non-magnetic conductive member.

7. The developing method according to claim 6, wherein the thickness of said developer applied onto said non-magnetic conductive member is greater than 50μ and smaller than 200μ.

8. The developing method according to claim 1, wherein the minimum clearance between said latent image bearing member and said non-magnetic conductive member is greater than 100μ and smaller than 500μ.

9. The developing method according to claim 1, wherein said magnet is stationarily supported within said non-magnetic conductive member and has a developing magnetic pole at a developing position opposed to the latent image.

10. A dry developing method comprising the steps of defining a developing zone wherein a latent image bearing member and a non-magnetic developer carrier carrying thereon a layer of one-component magnetic developer are disposed in opposed relationship in a developing station with a clearance therebetween, the clearance being greater than the thickness of said developer layer so as to create an air gap, providing a magnetic field in said developing zone and effecting development while applying an alternating electric field in a range satisfying the relations:

$$400\ V \leqq V_{p\text{-}p} \leqq 2500\ V$$

$$40\ Hz \leqq f \leqq 1.5\ KHz$$

where $V_{p\text{-}p}$ represents the amplitude of the alternating electric field (V: peak-to-peak value) and f represents the alternating frequency of the alternating electric field, to apply an alternating electric field having a phase of a particular polarity which causes said developer to one-sidedly reach both the image area and the non-image area of said latent image bearing member from said developer carrier in said developing clearance and a phase of the opposite polarity to said particular polarity for applying a bias in a direction to cause said developer having reached at least said non-image area to return to said developer carrier side.

11. The developing method according to claim 10, wherein said latent image bearing member is in the form of a drum, said developer carrier is a rotatable member, and said latent image bearing member and said developer carrier are arranged to define a most proximate position and positions of greater spacing than said most proximate position, whereby the intensity of said alternating electric field in said clearance is varied.

12. The developing method according to claim 10, wherein the combination of the amplitude and frequency of said alternating electric field is a combination of relatively high $V_{p\text{-}p}$ and relatively high f when the developing clearance d is great.

13. A dry developing method comprising the steps of defining a developing zone wherein an electrostatic latent image bearing member and a non-magnetic sleeve carrying thereon a layer of one-component magnetic developer are disposed in opposed relationship in a developing station with a clearance therebetween, the clearance being greater than the thickness of said developer so as to create an air gap, providing a magnetic field in said developing zone and effecting development while applying an alternating electric field in a range satisfying $$400\ V \leqq V_{p\text{-}p} \leqq 2500\ V$$

$$40\ Hz \leqq f \leqq 1.5\ KHz$$

where $V_{p\text{-}p}$ represents the amplitude of the alternating electric field (V: peak-to-peak value) and f represents the alternating frequency of the alternating electric field, so that the electric field in said developing clearance applies an alternating electric field having a phase of a particular polarity which causes the magnetic developer to one-sidedly reach both the image area and the non-image area of said electrostatic latent image bearing member from said sleeve and a phase of the opposite polarity to said particular polarity which causes magnetic developer which has reached at least said non-image area to return to said sleeve side.

14. The developing method according to claim 13, wherein said alternating electric field is asymmetric.

15. The developing method according to claim 14, wherein said alternating electric field is applied in the form of an AC voltage with a DC voltage superimposed thereon.

16. The developing method according to claim 14, wherein said alternating electric field is formed by distorting the waveform of an AC voltage.

17. A dry developing method for developing an electrostatic image comprising the steps of:

defining a developing zone wherein an electrostatic image bearing member and a non-magnetic carrier carrying thereon a layer of one-component magnetic developer are disposed in opposed relationship with a clearance therebetween to create an air gap;

providing a magnetic field in said developing zone;

applying an alternating electric field of low frequency to said developing zone, said alternating electric field acting on said developing clearance to realize the following developing processes:

a first developing process in said developing zone in which the developing clearance is greater than the developer layer on said developing carrier and said alternating electric field which acts on said clearance has a transition phase which causes the magnetic developer to one-sidedly reach both the image area and the non-image area of said electrostatic image bearing member from said developer carrier and a back transition phase which tends to cause the developer which has reached said image member to one-sidedly return to said developer carrier, said two phases being repeated in said first developing process; and and a second developing process in the developing zone in which the developing clearance is wider than that in said first developing process and said alternating electric field which acts on said clearance has a transition phase which causes the magnetic developer to one-sidedly reach only the image area of said electrostatic image bearing member from said developer carrier and a back transition phase which tends to cause the magnetic developer present in the non-image area of said electrostatic image bearing member to one-sidedly return to said developer carrier, said two phases being repeated in said second developing process.

18. The developing method according to claim 17, wherein the frequency of said alternating electric field is lower than 1.5 KHz and higher than 40 Hz.

19. A dry developing method comprising the steps of defining a developing zone wherein an electrostatic image bearing member and a non-magnetic developer carrier carrying thereon a one-component magnetic developer layer are disposed in opposed relationship in a developing station with a clearance therebetween to create an air gap providing a magnetic field in said developing zone, and effecting development by applying an alternating voltage having a frequency lower than 1.5 KHz between a back electrode of said electrostatic image bearing member and said developer carrier, said frequency and said alternating voltage value being selectively changed over in accordance with the characteristics of the image.

20. A dry developing method comprising the steps of defining a developing zone wherein an electrostatic latent image bearing member and a non-magnetic sleeve carrying thereon a layer of one-component magnetic developer are disposed in opposed relationship in a developing station with a clearance therebetween, the clearance being greater than the thickness of said developer layer so as to create an air gap, providing a magnetic field in said developing zone, and effecting development while applying an alternating electric field in a range satisfying the relations:

$$\begin{cases} 400\ \text{V} \leqq V_{p-p} \leqq 2500\ \text{V} \\ 40\ \text{Hz} \leqq f \leqq 1.5\ \text{KHz} \end{cases}$$

where $V_{p-p}$ represents the amplitude of the alternating electric field and f represents the alternating frequency of the alternating electric field, so that the electric field in the developing zone applies an alternating electric field having a phase of a polarity which causes the magnetic developer to one-sidedly reach both the image area and the non-image area of said electrostatic latent image bearing member from said sleeve and a phase of the opposite polarity which causes said magnetic developer which has reached at least said non-image area to return to said sleeve side, said frequency and said amplitude value being selectively changeable within said range in accordance with the characteristics of the image.

21. The developing method according to claim 20, wherein the following relation is satisfied:

$$f \geqq 0.3 \times V_p\ (\text{Hz})$$

where $V_{p-p}$ represents the amplitude of the alternating electric field (V: peak-to-peak value) and f represents the alternating frequency of the alternating electric field.

22. The developing method according to claim 1, wherein said alternating electric field satisfies the relations:

$$\begin{cases} 400\ \text{V} \leqq V_{p-p} \leqq 2500\ \text{V} \\ 40\ \text{Hz} \leqq f \leqq 1.5\ \text{KHz} \end{cases}$$

where $V_{p-p}$ represents the amplitude of the alternating electric field and f represents the alternating frequency of the alternating electric field.

23. A dry developing method for developing a latent image comprising the steps of:

defining a developing zone wherein a latent image bearing member and a non-magnetic conductive member carrying one-component magnetic developer particles thereon are disposed in opposed relationship in a developing station with a clearance therebetween, said clearance being greater than the thickness of said developer particles carried on the non-magnetic conductive member so as to create an air gap;

providing a magnetic field in said developing zone; and applying an alternating electric field to said clearance to effect development, said clearance being in the range of between 100 microns and 500 microns, and said alternating electric field having its peak-to-peak amplitude value in said clearance in the range of between 400 v and 2500 v.

24. A dry developing device for developing an electrostatic latent image carried on a latent image bearing member comprising:

non-magnetic means for carrying a one-component magnetic developer;

means for defining a developing zone by disposing said latent image bearing means and said non-magnetic carrying means in opposed relationship in a developing station with a predetermined clearance therebetween;

means for providing a magnetic field in said developing zone; and means for moving said latent image bearing means and said non-magnetic carrying means;

means for applying an alternating electric field to said developing zone, said alternating electric field producing electric fields in said developing clearance which alternate both in the image area and in the non-image area of said latent image bearing means.

25. The developing device according to claim 24 wherein the alternate voltage for producing said alternate electric field is in a range satisfying the relations:

$$\begin{cases} 400\ \text{V} \leqq V_{p-p} \leqq 2000\ \text{V} \\ 40\ \text{Hz} \leqq f \leqq 1.5\ \text{KHz} \end{cases}$$

where $V_{p-p}$ represents the amplitude of the alternating electric field (V:peak-to-peak value) and f represents the alternating frequency of the alternating electric field.

26. The developing device according to claim 24, wherein said magnetic developer is applied onto said developer carrier, means with a magnetic member disposed at a position opposed to a magnetic pole provided within said developer carrier means and with a clearance of 50 to 500 $\mu$ maintained between the end of said member and the surface of said developer carrier means.

27. The developing device according to claim 26, wherein the thickness of the developer applied onto said developer carrier means is greater than 50 $\mu$ and smaller than 200 $\mu$.

28. The developing device according to claim 24, wherein the minimum clearance between said electrostatic latent image bearing means and said developer carrier means is greater than 100 $\mu$ and smaller than 500 $\mu$.

29. A developing device comprising an image bearing member having a back electrode and having an electrostatic latent image thereon, a non-magnetic sleeve carrying thereon a one-component magnetic developer and having a magnet therewithin, means for disposing said image bearing member and said non-magnetic sleeve in opposed relationship in a developing station with a predetermined clearance therebetween, means for applying an alternating electric field to said developing clearance, said alternating electric field having a phase of a particular polarity which causes the magnetic developer in said developing clearance to one-sidedly reach both the image area and the non-image area of said image bearing member and a phase of the opposite polarity to said particular polarity which causes the magnetic developer which has reached at least said non-image area to return to said sleeve side, and means whereby from said alternate electric field having a range satisfying $$\begin{cases} 400\ \text{V} \leqq V_{p-p} \leqq 2500\ \text{V} \\ 40\ \text{Hz} \leqq f \leqq 1.5\ \text{KHz} \end{cases}$$

where $V_{p-p}$ represents the amplitude of said alternating electric field (V:peak-to-peak value) and f represents the alternating frequency of said alternating electric field, said frequency and amplitude value are selectively changed over in accordance with the characteristics of the image.

30. The developing device according to claim 29, wherein as a member for applying said magnetic developer onto said sleeve, use is made of a magnetic member disposed at a position opposed to a magnetic pole within said sleeve and with a clearance of 50 to 500 $\mu$ maintained between the end of said member and the surface of said sleeve.

31. The developing device according to claim 29, wherein the thickness of the developer applied onto said sleeve is greater than 50 $\mu$ and smaller than 200 $\mu$.

32. The developing device according to claim 31, wherein the minimum clearance between said electrostatic latent image bearing member and said sleeve is greater than 100 $\mu$ and smaller than 500 $\mu$.

* * * * *

UNITED STATES PATENT AND TRADEMARK OFFICE

CERTIFICATE OF CORRECTION

PATENT NO. : 4,292,387

DATED : September 29, 1981

INVENTOR(S) : JUNICHIRO KANBE, ET AL.

It is certified that error appears in the above-identified patent and that said Letters Patent are hereby corrected as shown below:

Column 4, line 22, after "with" change "some" to --the--.

Column 5, line 37, "imgage" should be --image--.

Column 8, line 2, "100 μis" should be --100 μ is--;

line 44, "effec" should be --effect--;

line 64, "ad" should be --and--.

Column 10, line 2, "beings" should be --begins--.

Column 11, line 43, change "encircles" to --encircled--.

Column 12, line 68, change "methods" to --method--.

Signed and Sealed this

Second Day of November 1982

[SEAL]

*Attest:*

GERALD J. MOSSINGHOFF

*Attesting Officer*

*Commissioner of Patents and Trademarks*